US011759972B2

(12) United States Patent
Dietrich et al.

(10) Patent No.: US 11,759,972 B2
(45) Date of Patent: Sep. 19, 2023

(54) GYPSUM FIBERBOARD PANEL AS WELL AS METHOD AND APPARATUS FOR THE PRODUCTION OF A GYPSUM FIBERBOARD PANEL

(71) Applicant: James Hardie Europe GmbH, Duesseldorf (DE)

(72) Inventors: Thomas Dietrich, Salzgitter (DE); André Blasig, Bad Grund (DE); Thomas Gudermuth, Langelsheim (DE)

(73) Assignee: James Hardie Europe GmbH, Duesseldorf (DE)

( * ) Notice: Subject to any disclaimer, the term of this patent is extended or adjusted under 35 U.S.C. 154(b) by 552 days.

(21) Appl. No.: 16/665,287

(22) Filed: Oct. 28, 2019

(65) Prior Publication Data

US 2020/0130227 A1 Apr. 30, 2020

(30) Foreign Application Priority Data

Oct. 29, 2018 (DE) ..... 10 2018 218 512.3

(51) Int. Cl.
*B28B 1/52* (2006.01)
*B28B 17/02* (2006.01)

(52) U.S. Cl.
CPC ..... *B28B 1/521* (2013.01); *B28B 1/526* (2013.01); *B28B 17/023* (2013.01)

(58) Field of Classification Search
None
See application file for complete search history.

(56) References Cited

U.S. PATENT DOCUMENTS 3,634,559 A * 1/1972 Haes et al. ..... B28B 1/265 264/437
3,832,250 A 8/1974 Pearson
(Continued)

FOREIGN PATENT DOCUMENTS

DE 2751446 5/1978
DE 2751473 5/1979
(Continued)

OTHER PUBLICATIONS

DIN EN 15283-2, Dec. 2009, with English translation, total of 87 pages.
(Continued)

*Primary Examiner* — Jacob T Minskey
*Assistant Examiner* — Caroline Beha
(74) *Attorney, Agent, or Firm* — Knobbe, Martens, Olson & Bear LLP

(57) ABSTRACT

A method for production of a gypsum fiberboard panel, has the following method steps: production of a mixture of calcined gypsum and fibers; application of the mixture to a gas-permeable and/or air-permeable and/or liquid-permeable conveyor that continuously moves in an advancing direction, at an advancing speed; pre-compaction of the mixture; wetting of the mixture with setting water; post-compaction of the mixture; pressing the mixture to form a gypsum fiberboard panel strand; cutting the gypsum fiberboard panel strand into individual gypsum fiberboard panels; drying the gypsum fiberboard panels; and if necessary, finishing and/or coating the dried gypsum fiberboard panels; wherein for pre-compaction, the mixture is sprayed with a water mist and has a partial vacuum applied to it. Furthermore, an apparatus produces a gypsum fiberboard panel, in particular by carrying out the method, and a gypsum fiber-
(Continued)

board panel is produced using the method and/or using the apparatus.

13 Claims, 2 Drawing Sheets

(56) References Cited

U.S. PATENT DOCUMENTS

| | | | | | |
|---|---|---|---|---|---|
| 4,588,443 | A * | 5/1986 | Bache | B28B 23/0081 | 106/676 |
| 5,445,849 | A * | 8/1995 | Delvaux | C04B 14/40 | 427/372.2 |
| 5,531,946 | A * | 7/1996 | Bold | B28B 5/027 | 156/39 |
| 8,038,790 | B1 * | 10/2011 | Dubey | B28B 23/0087 | 106/711 |
| 2001/0053333 | A1 * | 12/2001 | Messier | B65D 83/682 | 422/298 |
| 2003/0049450 | A1 * | 3/2003 | Song | B28B 1/526 | 428/408 |
| 2008/0190062 | A1 * | 8/2008 | Engbrecht | C04B 28/14 | 442/79 |
| 2009/0126886 | A1 * | 5/2009 | Englert | C03C 25/30 | 162/151 |
| 2017/0362126 | A1 * | 12/2017 | Voigt | B28B 5/026 | |
| 2019/0270847 | A1 * | 9/2019 | Alidedeoglu | C08G 63/78 | |

FOREIGN PATENT DOCUMENTS

| | | | | |
|---|---|---|---|---|
| DE | 3216886 | | 11/1983 | |
| DE | 3228159 | A1 | 2/1984 | |
| DE | 10 2009 039 517 | | 3/2011 | |
| EA | 17468 | | 12/2012 | |
| EP | 0 260 342 | A1 | 3/1988 | |
| GB | 1258288 | A * | 12/1971 | B28B 1/521 |
| KG | 212 | C2 | 10/1997 | |
| KZ | 31688 | | 12/2016 | |
| RU | 2210553 | | 8/2003 | |
| RU | 2589784 | | 7/2016 | |
| WO | WO 1993/00483 | | 1/1993 | |
| WO | 93/04830 | A1 | 3/1993 | |
| WO | WO 2016/101968 | | 6/2016 | |

OTHER PUBLICATIONS

European Search Report for Application No. 19202094.9, dated Apr. 1, 2020.

European Examination Report for Application No. 19202094.9, dated Jan. 26, 2021.

Search Report for Russian Application No. 2019134478, dated Oct. 28, 2019.

European Examination Report for German Application No. 1020188218512.3, dated Sep. 12, 2019.

* cited by examiner

GYPSUM FIBERBOARD PANEL AS WELL AS METHOD AND APPARATUS FOR THE PRODUCTION OF A GYPSUM FIBERBOARD PANEL

CROSS REFERENCE TO RELATED APPLICATIONS

Applicant claims priority under 35 U.S.C. § 119 of German Application No. 10 2018 218 512.3 filed Oct. 29, 2018, the disclosure of which is incorporated by reference.

BACKGROUND OF THE INVENTION

1. Field of the Invention

The present invention relates to a gypsum fiberboard panel or fiber-reinforced gypsum plasterboard panel, in particular in accordance with DIN EN 15283-2, as well as to a method and an apparatus for production of such a gypsum fiberboard panel.

2. Description of the Related Art

Gypsum fiberboard panels are used as construction panels, fire-protection panels, noise-protection panels and wet-room panels, for planking (load-bearing) and cladding (non-load-bearing) of components, for example walls, ceilings, pillars or girders. Gypsum fiberboard panels serve, in particular, also as finished-part/dry-floor elements, hollow-floor elements and double-floor elements, to form floor constructions.

In the production of gypsum fiberboard panels, a dry mixture is formed from calcined gypsum, fibers, and, if applicable, admixtures. After addition of water, without further binders, the dry mixture is formed into panels and dried. The gypsum sets due to the water, and penetrates and sheathes the fibers. The setting process therefore has a decisive influence on the quality of the gypsum fiberboard panels. In particular, it has been shown that greater panel strength can be achieved by means of setting that is as uniform as possible.

The difficulty in bringing about a uniform setting process is ensuring that the most complete and uniform wetting of the dry mixture takes place with the setting water that is to be added, if at all possible without allowing an excess of water to occur in this regard. Methods that are directed at achieving setting that is as uniform as possible are known.

WO 93/04830 A1 discloses a method for the production of gypsum fiberboard panels according to a semi-dry process. In this regard, at least one layer of a mixture of gypsum, fibers, and water is spread onto a continuously moving belt. Subsequently, the spread layer is pre-compacted in a pre-press that has pressing rolls that lie opposite one another, to 110 to 180% of the desired panel thickness; subsequently, it is wetted again with an upper and lower spraying apparatus, and finally it is pressed to the panel thickness in the main press. The spray apparatuses disposed between pre-press and main press are combined with a vacuum box having a fan, in each instance.

EP 0 260 342 A1 relates to a method for the production of molded parts composed of gypsum and fibers that contain lignocellulose, using a dry process. In this method, gypsum powder is mixed with the fibers as a hemihydrate; this dry mixture is poured into the desired mold, pre-compacted in a press, and subsequently pressed, in the same press, to form the molded parts, wherein the gypsum powder is converted from the hemihydrates to dehydrate, using water, and the pressed molded parts are dried by means of the action of heat. The water required for conversion of the gypsum is added to the gypsum/fiber mixture after it has been pre-compacted.

In practice, it has been shown that it cannot be ensured, using the pre-compaction techniques that are usually used, for example by means of pressure rolls, that uniform and complete wetting of the gypsum/fiber mixture (called a cake) will always take place during the subsequent pressing process. In particular in the production of gypsum fiberboard panels that are supposed to have a thickness of 30 mm, for example for use as floor elements, the water can penetrate into the cake only in part. This can lead to a considerably greater proportion of water in the upper region of the panel, and during the pressing process, this can lead to squeezed areas in the upper region and/or dry spots in the lower region.

This is a known problem. Currently, two thinner panels are connected with one another for the production of thicker gypsum fiberboard panels.

SUMMARY OF THE INVENTION

The present invention is based on the task of creating a method for the production of a gypsum fiberboard panel, by means of which complete and uniform wetting and setting of the gypsum/fiber mixture is guaranteed, and by means of which it is also possible, in particular, to produce panels having a thickness>25 mm.

It is a further task of the invention to make available an apparatus for the production of such a gypsum fiberboard panel, by means of which complete and uniform wetting and setting of the gypsum/fiber mixture is guaranteed, and by means of which it is also possible to produce panels having a thickness>25 mm.

Furthermore, it is a task of the invention to make available a gypsum fiberboard panel that can be produced using a uniform wetting and setting process, wherein in particular, the formation of squeezed areas or dry spots is supposed to be prevented during production, also in the case of panels having a thickness>25 mm.

These tasks are accomplished by means of a method having the characteristics according to one aspect of the invention, as well as by means of an apparatus having the characteristics according to another aspect of the invention, as well as by means of a gypsum fiberboard panel having the characteristics according to a further aspect of the invention. Advantageous further developments of the invention are indicated below.

The method according to the invention comprises the following method steps:

- production of a preferably dry mixture of gypsum and fibers,
- application of the mixture to a gas-permeable and/or air-permeable and/or liquid-permeable conveying means that continuously moves in an advancing direction, at an advancing speed,
- pre-compaction of the mixture,
- wetting of the mixture with setting water,
- post-compaction of the mixture,
- pressing the mixture to form a gypsum fiberboard panel strand,
- cutting the gypsum fiberboard panel strand into individual gypsum fiberboard panels,
- drying the gypsum fiberboard panels, if necessary, finishing and/or coating the dried gypsum fiberboard panels.

According to the invention, the method is characterized in that for pre-compaction, the mixture is sprayed with a water mist, and, preferably at the same time, a partial vacuum is applied to it.

It is advantageous, in the case of the method according to the invention, that the water mist is drawn into the gypsum/fiber mixture during pre-compaction, in such a manner that the mixture can be uniformly wetted over its entire cross-section. As a result, gypsum and fibers are made more capable of absorbing water, so that the mixture is uniformly and completely wetted with the amount of setting water that is added later.

The gypsum fiberboard panels produced in this manner are characterized by great strength, in particular bending resistance according to DIN EN 15283-2, and great raw density, depending on the settings of the overall system.

Furthermore, in the case of the method according to the invention, the pre-compaction can be adapted to the panel thickness to be produced, in that water mist and/or partial vacuum are coordinated accordingly. The method according to the invention thereby makes possible the production of different panel thicknesses and an increase in advancing speed depending upon the panel thickness. As a result, the throughput and the production sequence in the production of gypsum fiberboard panels are improved.

In particular, gypsum fiberboard panels having great strength, with a panel thickness>25 mm, can be reliably and reproducibly produced using the method according to the invention. The method thereby makes possible the production of floor elements that are composed of a single thick gypsum fiberboard panel, instead of two thin panels that are connected with one another.

Within the scope of the invention, the gypsum used can be a gypsum obtained from gypsum rock, called natural gypsum, in particular building plaster or stucco, as well as industrially produced calcium sulfate or calcium sulfate that occurs as a byproduct in technical processes, called technical gypsum, in particular gypsum derived from flue gas desulfurization systems (FGD gypsum). Also, calcium sulfate modifications from dismantling and recycling (recycled gypsum) can be used.

Within the scope of the invention, all fibers suitable for the production of gypsum fiberboard panels can be used, in particular fibers that contain cellulose, for example recycled paper fibers or artificial mineral fibers, for example glass fibers.

Furthermore, it lies within the scope of the invention that an aggregate, preferably expanded perlite and/or mica, and/or an additive, preferably pigment, can be added to the mixture, and/or that an admixture, preferably a setting accelerator or setting delay agent and/or hydrophobic agent, can be added to the mixture and/or to the setting water.

According to an advantageous embodiment of the method, a first surface of the mixture, preferably its free top side facing away from the conveying means, is sprayed with the water mist for pre-compaction, and the partial vacuum is applied on a second surface of the mixture, which lies opposite the first, preferably on its underside that faces the conveying means. Preferably, this takes place at the same time.

Preferably, a water/solid value w/s of 0.05 to 0.25, preferably of 0.1, is produced in the mixture for pre-compaction with the water mist.

The water mist is an aerosol, in particular composed of liquid aerosol particles in ambient air, having an average particle size of 0.1 to 60 μm, preferably 15 μm.

Preferably, a partial vacuum of 5 to 20 mbar, preferably of 10 to 15 mbar, preferentially of 10 mbar is applied to the mixture for pre-compaction.

According to a further advantageous embodiment, the mixture also has a partial vacuum applied to it for post-compaction. In particular, in this regard, a partial vacuum of 10 to 25 mbar, preferably of 15 to 20 mbar, preferentially of 20 mbar is generated. Particularly preferably, the partial vacuum is applied to increase slowly in the advancing direction of the conveying means, for example in that the amount of air drawn off to generate the partial vacuum is increased section by section in the advancing direction.

Preferably, the partial vacuum is applied to an underside of the conveying means or on the conveying means underside, in each instance, for pre-compaction and/or post-compaction, so that the partial vacuum acts on the mixture through the conveying means.

Preferably, gypsum fiberboard panels having a thickness of 6 to 50 mm are produced using the method according to the invention. In particular, gypsum fiberboard panels in the usual thickness range, having a thickness of 10 to 25 mm, particularly preferably of 10 to 18 mm, or thick gypsum fiberboard panels having a thickness of 25 to 40 mm, particularly preferably of 30 mm, are produced.

In this regard, the gypsum fiberboard panel that can be produced or has been produced according to the invention preferably has the following material properties:

Raw density (according to DIN EN 15283-2) of 1000 to 1500 kg/m$^3$, preferably of 1200 kg/m$^3$, Bending strength (according to DIN EN 15283-2) of 4 to 15 N/m$^2$, preferably of 7 N/m$^2$.

The apparatus according to the invention for the production of a gypsum fiberboard panel comprises:

- a conveying device having a conveying means that can be driven in an advancing direction at an advancing speed, in particular a transport belt, for conveying raw materials, wherein the conveying means is configured in such a manner that it can have gases and/or air and/or water flowing through it,
- a raw material application device having a feed device for applying a mixture that consists essentially of gypsum and fibers, in particular a dry mixture, to the conveying means,
- a pre-compaction device that follows the feed device in the advancing direction,
- a wetting device and a post-compaction device that follow the pre-compaction device in the advancing direction,
- a pressing device that follows the post-compaction device in the advancing direction, as well as
- a cutting device that follows the pressing device in the advancing direction.

According to the invention, the apparatus is characterized in that the pre-compaction device has means for spraying the mixture with a water mist, as well as means for preferably simultaneous application of a partial vacuum to the mixture.

The apparatus is particularly suitable for carrying out the method according to the invention, and also has the advantages described above.

In particular, in the case of the apparatus according to the invention, the pre-compaction device can be adapted to the panel thickness to be produced, in that water mist and/or partial vacuum are coordinated accordingly. By means of the apparatus according to the invention, it is possible to increase the advancing speed as a function of the panel thickness. The apparatus thereby guarantees higher throughput and an improved production sequence during production.

In particular, it is also possible to produce gypsum fiberboard panels having great strength, with a panel thickness>25 mm, in reliable and reproducible manner, using the apparatus according to the invention, for example floor elements that are composed of a single thick gypsum fiberboard panel.

According to a preferred embodiment, the apparatus is configured in such a manner that with the pre-compaction device, a first surface of the mixture, preferably its free top side that faces away from the conveying means, can be sprayed with the water mist, and the partial vacuum can be applied to a second surface of the mixture that lies opposite the first, preferably to its underside that faces the conveying means.

Preferably, the pre-compaction device comprises means for spraying, by means of which the mixture can be sprayed with fine water droplets having an average droplet size of 0.1 to 60 μm, preferably 15 μm, in particular depending upon thickness with a water amount of 1 to 10 l/h.

Preferably, the means for spraying have at least one mist nozzle, preferably 1 to 35 mist nozzles, particularly preferably 14 to 28 mist nozzles, with which the water mist can be sprayed at an air pressure of 2 to 4 bar, preferably 3 bar, and a liquid pressure of 1 to 3 bar, preferably 2 bar, and a jet angle of 40° to 80°, preferably 60°. In particular, the mist nozzles are pneumatic atomizer nozzles.

Preferably, the pre-compaction device comprises means for applying a partial vacuum to the mixture, wherein the means are configured for applying a partial vacuum of 5 to 20 mbar, preferably of 10 to 15 mbar, preferentially of 10 mbar to the mixture. Preferably, the means are configured in such a manner that the partial vacuum can be applied at an underside of the conveying means, wherein the partial vacuum can be applied to the mixture through the conveying means.

According to a further advantageous embodiment, the post-compaction device also has means for generating a partial vacuum, wherein preferably, a partial vacuum of 10 to 25 mbar, preferably of 15 to 20 mbar, preferentially of 20 mbar can be applied to the mixture.

Preferably, the post-compaction device follows the wetting device in the advancing direction of the conveying means, wherein the partial vacuum that can be generated by the means of the post-compaction device can be applied to an underside of the conveying means, so that the partial vacuum can be applied to the mixture through the conveying means. Particularly preferably, the means for generating a partial vacuum are configured in such a manner that the amount of air drawn off to generate the partial vacuum can be increased, section by section, in the advancing direction of the conveying means.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

In the individual figures, the same parts are always provided with the same reference symbols. Furthermore, in connection with the figure description, it is explicitly emphasized that the invention is not restricted to the exemplary embodiments shown and thereby not to all or multiple characteristics of the combinations of characteristics that are described. Instead, each individual partial characteristic of the exemplary embodiment or of each exemplary embodiment can also have inventive significance even dissociated from all the other partial characteristics described in connection with it, by itself and also in combination with any desired characteristics of another exemplary embodiment, and also independent of the claims and their antecedents.

Figure 1:
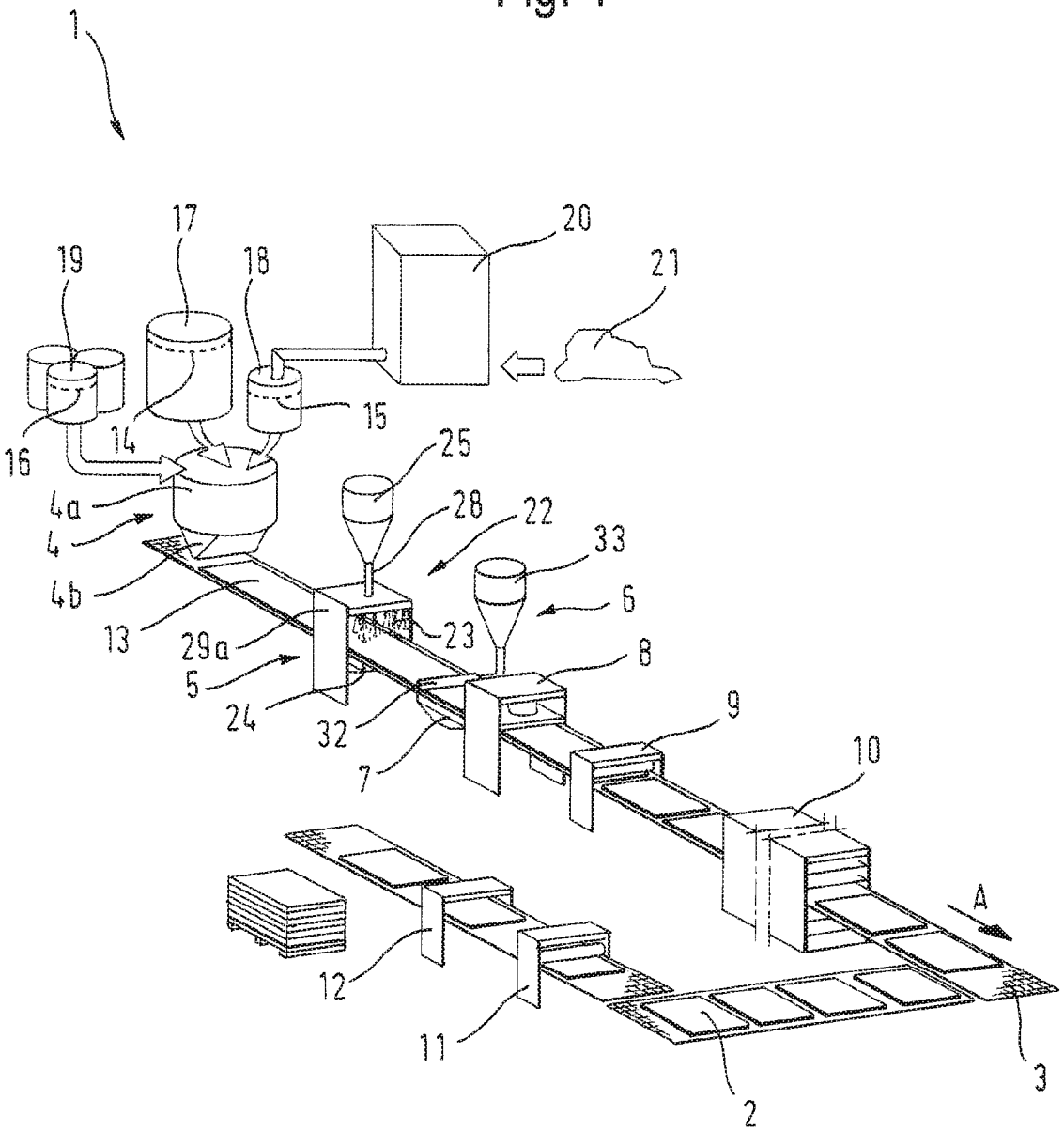
FIG. 1 shows an apparatus according to the invention.

An apparatus 1 according to the invention, for production of a gypsum fiberboard panel 2, is shown in FIG. 1. The apparatus 1 has a conveying device 3 having a conveying means 3*a* that can be driven in an advancing direction A, for conveying a raw material mixture 13 that can be poured. The apparatus 1 furthermore comprises a raw material application device 4, a pre-compaction device 5, a wetting device 6, a post-compaction device 7, a pressing device 8, a cutting device 9, a drying device 10, a finishing device 11, and a coating device 12, which are disposed one behind the other in the advancing direction A of the conveying means and through which the latter can pass.

Figure 2:
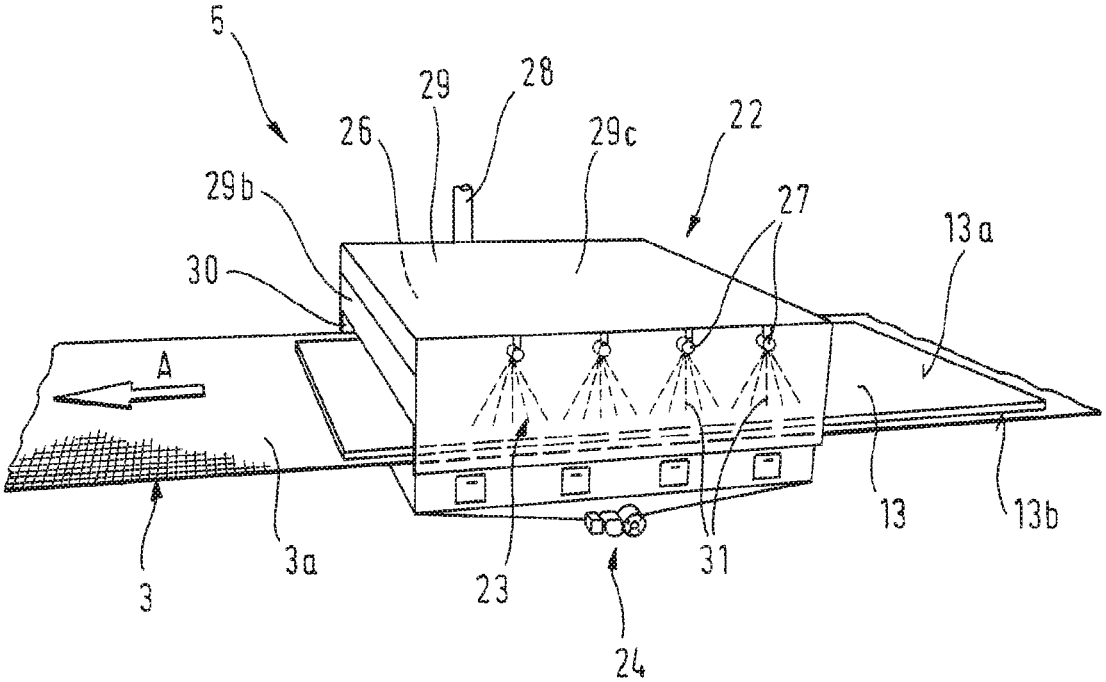
FIG. 2 shows a pre-compaction device used in the method according to the invention and in the apparatus according to the invention.
Figure 2:
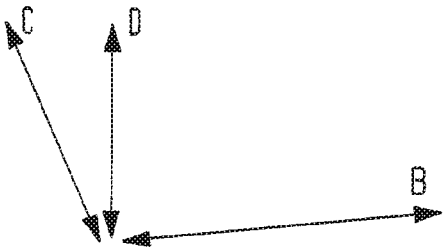

The conveying device 3 is configured as a driven conveyor belt and, in particular, has a screen belt 3*a* as the conveying means (FIG. 2). Furthermore, the conveying device 3 has known drive means, for example electric motors, with which the screen belt 3*a* can be driven in the advancing direction A at an advancing speed $V_A$. An advancing speed $V_A$ of 50 to 500 mm/s, for example, can be set depending upon the thickness of the raw material mixture 13. The screen belt 3*a* has a contact surface to which the mixture 13 can be applied. The screen belt 3*a* is gas-permeable and water-permeable, i.e. is formed from a gas-permeable and water-permeable material, in particular air-permeable, so that gases, in particular the ambient air, can flow into the screen belt 3*a* from one side and flow out again on the other side. This will be discussed in greater detail below.

The raw material application device 4 has a mixing device 4*a* and a feed device 4*b*. The raw material application device 4 is a spreading machine, for example.

The mixing device 4*a* is connected with a supply container 17 for gypsum 14, a supply container 18 for paper fibers 15, and further supply containers 19 for aggregates, additives, and admixtures 16. The mixing device 4*a* can be filled from the containers 17, 18, 19 with an amount of gypsum 14, fibers 15, and other materials 16 determined for production of the mixture 13. The mixing device 4*a* thereby serves for mixing and producing the mixture 13.

It is advantageous if a paper processing device 20 is assigned to the fiber container 15 of the mixing device 4*a*, by means of which former device scrap paper 21, which can be passed to the processing device 20, can be recycled to produce the paper fibers 15. The paper processing device 20 involves hammer mills and fiber mills.

The feed device 4*b* is connected with the mixing device 4*a*. The feed device 4*b* is configured in such a manner that the mixture 13 that can be produced by the mixing device 4*a* can be spread onto the screen belt 3*a* with a predeterminable mixture height or mixture thickness.

The pre-compaction device 5, which is shown in greater detail in FIG. 2, has means for spraying 22 the mixture 13 with a water mist 23 as well as means 24 for applying a partial vacuum to the mixture 13, preferably at the same time.

The means for spraying 22 comprise a water supply container 25, a spray chamber 26 having at least one mist nozzle 27 for producing the water mist 23, as well as a water feed line 28, by means of which the water can be fed to the mist nozzle 27 from the water supply container 25.

The spray chamber 26 has a preferably block-shaped housing 29, which is disposed above the screen belt 3*a*. The housing 29 is preferably disposed so as to surround or enclose the screen belt 3*a*, so that the screen belt can move through a housing interior or spray chamber interior. In particular, the housing 29 has two opposite side walls 29*a*, which extend parallel to the advancing direction A in a longitudinal direction B, as well as two end walls 29*b*, which run perpendicular to these and extend in a width direction C, as well as a ceiling wall 29*c* that extends perpendicular to the walls 29*a*, 29*b* and extends in a height direction D. The end walls 29*b* have a passage opening 30, in each instance, through which the screen belt 3*a*, with the mixture 13 lying on it, can be conveyed into the housing 29 or into the spray chamber 26 on one housing side, and conveyed out again on the opposite housing side. The passage opening 30 has a width in the width expanse of the screen belt 3*a* or in the width direction C, and, perpendicular to this, a height in the height direction D. The width is dimensioned in such a manner that the screen belt 3*a* can be moved through the passage opening 30 with the smallest possible distance, preferably of 1 to 5 mm, from the respective side wall 29*a*. The height of the passage opening 30 corresponds to the distance of a lower edge of the side wall 29*b* from the screen belt 3*a* or from the mixture 13. Preferably, the height of the passage opening 30 can be adapted to the height of the mixture 13 determined to be spread onto the screen belt 3*a*. In particular, the end wall 29*b* can be moved up and down, in driven manner, in the height direction D, so that the height of the passage opening 30 can be increased or reduced.

The mist nozzles 27 are disposed within the housing 29, preferably on the ceiling wall 29*c*. Preferably, 1 to 35, preferentially 14 to 28 mist nozzles 27 are provided. It is practical if the mist nozzles 27 are disposed in the spray chamber 26 distributed at a regular distance from one another, and directed in the direction of the screen belt 3*a*, so that a first free top side 13*a* of the mixture 13, facing away from the conveying means, can be uniformly sprayed with the water mist 23. Preferably, the mist nozzles 27 are configured, in each instance, for spraying an aerosol consisting of gas, for example nitrogen, or air and of water particles, having a droplet path configured in cone-like manner, i.e. an aerosol cone 31. For example, the aerosol cone 31 can be generated with an air pressure of 2 to 4 bar, preferably 3 bar, and a liquid pressure of 1 to 3 bar, preferably 2 bar, and a jet angle of 40 to 80°, preferably 60°, wherein the water particles have an average droplet size, in particular, of 0.1 to 60 μm, preferably 15 μm. The mist nozzles 27 are, for example, pneumatic atomizer nozzles, type Lechler 136.231.35 A2.

The water mist 23 that can be sprayed onto the mixture 13 by the means 22 for spraying is thereby preferably formed of multiple aerosol cones 31. Preferably, the mixture 13 can be continuously sprayed with the water mist 23.

The means 24 for applying a partial vacuum to the mixture 13 have a partial vacuum generation device (not shown), by means of which a partial vacuum can be generated and can be applied to an underside 13*b* that lies opposite the free top side 13*a* and faces the conveying means. Preferably, the means 24 are structured in such a manner so as to apply the partial vacuum on an underside of the screen belt 3*a*, so that the partial vacuum can be applied to the mixture 13 through the screen belt 3*a*. Preferably, a partial vacuum of 5 to 20 mbar, preferably of 10 to 15 mbar, preferentially of 10 mbar can be applied to the mixture 13. By means of applying the partial vacuum, the water mist 23 can be drawn into the mixture 13. Preferably, the means 24 are a vacuum tray.

The wetting device 6 has means 32 for watering the mixture 13 with the setting water required for setting of the gypsum/fiber mixture, as well as a water supply container 33 connected with the water supplying means 32, for feed of the setting water. The water supplying means 32 is preferably configured as a water curtain.

The post-compaction device 7 preferably has means for generating a partial vacuum, by means of which the setting water can be drawn into the mixture, post-compacting the mixture 13. Preferably, the means for generating a partial vacuum are formed analogous to the means 24 of the pre-compaction device 5 and have a partial vacuum generation device for applying a partial vacuum to the underside 13*b* of the mixture 13. Preferably, the partial vacuum can also be applied to the underside of the screen belt 3*a*, so that the partial vacuum can be applied to the mixture 13 through the screen belt 3*a*. Preferably, a partial vacuum of 10 to 25 mbar, preferably of 15 to 20 mbar, preferentially of 20 mbar can be applied to the mixture 13, using the post-compaction device 7. In particular, the partial vacuum can be applied in such a manner that the amount of air drawn off to generate the partial vacuum can be increased section by section along the conveyor belt underside, viewed in the advancing direction A. Preferably, the post-compaction device comprises a vacuum tray.

The pressing device 8 has means for pressing or compaction of the mixture 13 to produce a gypsum fiberboard panel strand, in particular a continuous one, having a thickness corresponding to the gypsum fiberboard panel 2 to be produced. The pressing device 8 is preferably a cycle press or ContiRoll press.

The cutting device 9 has means for disaggregation, for example cutting blades or water-jet cutters, of the gypsum fiberboard panel strand along the width direction C, to produce individual gypsum fiberboard panels 2. The cutting device 9 thereby serves for separating the gypsum fiberboard panel strand to produce the gypsum fiberboard panels 2.

The drying device 10 has means for drying the gypsum fiberboard panels 2. This is preferably a multi-level dryer.

The finishing device 11 has means for finishing the gypsum fiberboard panels 2, such as, for example, a grinding device, an edge profiling device or the like.

The coating device 12 has means for coating the gypsum fiberboard panel 2 with a coating agent, for example a hydrophobic agent and/or a dust-binding agent.

In the following, production, according to the invention, of a gypsum fiberboard panel 2, in particular continuous production, using the apparatus 1 according to the invention, will be described.

Gypsum 14, fibers 15, and, if applicable, aggregates and/or additives and/or admixtures 16 in accordance with a composition to be produced are placed into the mixing device 4*a*. In the mixing device 4*a*, these raw materials are mixed to produce the mixture 13, in particular the dry mixture 13.

In the method, a gypsum 14 made from natural gypsum, preferably building plaster or stucco, and/or technical gypsum, preferably FGD gypsum, and/or gypsum-like calcium sulfate modifications, preferably RC [recycled] gypsum, is used. In particular, FGD gypsum is used. Preferably, gypsum having a grain size of 1 μm to 1 mm, preferably of 10 to 200 μm is used.

Fibers that contain cellulose, preferably recycled paper fibers and/or artificial mineral fibers, preferably glass fibers and/or rock wool fibers are used as fibers 15. In particular, recycled paper fibers are used. Preferably, fibers 15 having an average fiber length of 63 μm to 2 mm are used.

In addition, usual aggregates, additives and/or admixtures can be used.

Preferably, a mixture 13 having the following composition is produced in the mixing device 4*a*:

| Raw material | Proportion [weight-%] |
|---|---|
| Gypsum | 75 to 85 |
| Fibers | 5 to 20 |
| Aggregate | 0 to 10 |
| Additive | 0 to 2 |

The advancing speed $V_A$ of the screen belt 3*a* of the conveying device 3 in the advancing direction A is preferably set to 5 to 500 mm/s (depending upon the thickness of the mixture 13).

The mixture 13 is applied to the screen belt 3*a* by means of the feed device 4*b*. Preferably, the mixture 13 is spread onto the screen belt 3*a* with a thickness or mixture height of 20 to 350 mm.

The mixture 13 is conveyed into the pre-compaction device 5 for pre-compaction, through the passage opening 30 of the spray chamber 26, which faces the mixing device 4*a*.

In the pre-compaction device 5, the free top side 13*a* of the mixture 13 is uniformly sprayed with the water mist 23, using the means 22. In this regard, the water mist 23 is preferably set in such a manner that the mixture 13 is sprayed with fine water droplets having an average droplet size of 0.1 to 60 μm, preferably 15 μm. In particular, aerosol cones 31 forming the water mist 23 and consisting of gas, for example nitrogen, or air and water particles, are produced using the mist nozzles 27. Preferably, in this regard, the aerosol cones 31 are produced with an air pressure of 2 to 4 bar, preferably 3 bar, and a liquid pressure of 1 to 3 bar, preferably 2 bar, and a jet angle of 40 to 80°, preferably 60°. Depending on the mixture height, the mixture 13 is sprayed with an amount of water of 1 to 10 l/h. For production of a panel thickness of 30 mm, the mixture is sprayed with an amount of water or amount of water mist of 7 l/h, for example.

Preferably, a water/solid value w/s of 0.05 to 0.25, preferably of 0.1, is produced in the mixture 13, using the means 22 for spraying.

In the pre-compaction device 5, a partial vacuum is furthermore applied to the underside 13*b* of the mixture 13, using the means 24, in particular at the same time with spraying of the mixture 13 with the water mist 23. With the partial vacuum, the water mist 23, i.e. the water particles contained in the water mist 23 are drawn into the mixture 13, and thereby the mixture 13 is compacted and made capable of absorbing water. Preferably, a partial vacuum of 5 to 20 mbar, preferably of 10 to 15 mbar, preferentially of 10 mbar is applied to the mixture 13 for pre-compaction. In particular, the partial vacuum is applied on the underside of the conveying means, so that the partial vacuum acts on the mixture 13 through the screen belt 3*a*.

After pre-compaction, the mixture 13 is passed to the wetting device 6 or conveyed into the wetting device 6. In the wetting device 6, the mixture 13, in particular the top side 13*a* of the mixture, is wetted or watered with the setting water required for setting the gypsum/fiber mixture, by means of the water curtain 32. Preferably, in this regard, a water/solid value w/s of 0.4 to 0.6, preferably of 0.5, is produced.

After wetting, the mixture 13 is conveyed into the post-compaction device 7 or the mixture 13 passes through the post-compaction device 7. A partial vacuum is applied to the underside 13*b* of the mixture 13, using the post-compaction device 7. The setting water is drawn into the mixture 13 with the partial vacuum, wherein the mixture 13 is further compacted or post-compacted. Preferably, a partial vacuum of 10 to 25 mbar, preferably of 15 to 20 mbar, preferentially of 20 mbar is applied to the mixture 13 for post-compaction. In particular, the partial vacuum is applied to the underside of the screen belt 3*a*, so that the partial vacuum is applied to the mixture 13 through the screen belt 3*a*. In particular, the partial vacuum is applied in such a manner that the amount of air drawn off to generate the partial vacuum is increased section by section along the underside of the screen belt, viewed in the advancing direction A.

However, it also lies within the scope of the invention that wetting and post-compaction take place simultaneously, in particular that a device configured analogous to the pre-compaction device is used for wetting and post-compaction.

The post-compacted mixture 13 is conveyed to the pressing device 8 and pressed to form a gypsum fiberboard panel strand having a thickness in accordance with the gypsum fiberboard panel 2 to be produced, using the means for pressing. Preferably, a pressure of 100 to 350 bar, in particular 300 bar is applied for pressing the mixture 13.

The gypsum fiberboard panel strand is conveyed to the cutting device 9 and separated into individual gypsum fiberboard panels 2 using the means for disaggregation.

The separated gypsum fiberboard panels 2 are conveyed into the drying device 10 and dried using the means for drying. Preferably, the gypsum fiberboard panels 2 are dried at a temperature of 80 to 260° C. for 40 to 100 minutes.

If necessary, the gypsum fiberboard panels 2 are profiled and/or reworked in the finishing device 11. For example, the gypsum fiberboard panels 2 can be provided with sharp-edged or profiled edges, or an edge can be produced having a flattened region that runs toward the panel edge.

After drying and finishing, the gypsum fiberboard panels 2 are coated with a coating agent, for example a hydrophobic agent or an agent for binding dust, in the coating device 12, if applicable.

In advantageous manner, the gypsum fiberboard panels 2 described above are produced with the following dimensions and material properties:

- Thickness 6 to 50 mm, preferably 10 to 25 mm, preferentially 10 to 18 mm,
- Raw density according to DIN EN 15283-2 of 1000 to 1500 kg/m$^3$, preferably of 1200 kg/m$^3$,
- Bending strength according to DIN EN 15283-2 of 4 to 15 N/m$^2$, preferably of 7 N/m$^2$.

In particular, one-part or one-piece gypsum fiberboard panels 2 having a panel thickness>25 mm can also be produced in reliable manner.

Although only a few embodiments of the present invention have been shown and described, it is to be understood that many changes and modifications may be made thereunto without departing from the spirit and scope of the invention.

What is claimed is:

1. A method for production of a gypsum fiberboard panel, the method comprising:

producing a mixture of calcined gypsum and fibers;

applying the mixture to a gas-permeable and/or air-permeable and/or liquid-permeable conveying means that continuously moves in an advancing direction, at an advancing speed;

pre-compacting the mixture, wherein during pre-compaction, the mixture is pre-wetted by spraying a first surface of the mixture with a water mist in the form of an aerosol having an average droplet size of 0.1 to 60 μm while a partial vacuum is applied to a second surface of the mixture opposite the first surface to draw the water mist into the mixture;

after the mixture is pre-wetted, wetting the pre-wetted mixture with setting water;

post-compacting the mixture;

pressing the mixture to form a gypsum fiberboard panel strand;

cutting the gypsum fiberboard panel strand into individual gypsum fiberboard panels;

drying the gypsum fiberboard panels; and if necessary, finishing and/or coating the dried gypsum fiberboard panels.

2. The method according to claim 1, wherein the mixture is produced with the following composition:

| Raw material | Proportion [weight-%] |
|---|---|
| Gypsum | 75 to 85 |
| Fibers | 5 to 20 |
| Aggregate | 0 to 10 |
| Additive | 0 to 2. |

3. The method according to claim 1, wherein the advancing speed of the conveying means is set to 50 to 500 mm/s.

4. The method according to claim 1, wherein a water/solid value w/s of 0.05 to 0.25 is produced in the mixture for pre-compaction with the water mist.

5. The method according to claim 1, wherein for pre-compaction, the mixture is sprayed with a water amount of 1 to 10 liters per hour.

6. The method according to claim 1, wherein 1 to 35 atomizer nozzles are used to generate the water mist, which are each operated at an air pressure of 2 to 4 bar and a liquid pressure of 1 to 3 bar and a jet angle of 40 to 80°.

7. The method according to claim 1, wherein a partial vacuum of 5 to 20 mbar is applied to the mixture for pre-compaction.

8. The method according to claim 1, wherein the partial vacuum is applied on the conveying means underside for pre-compaction, so that the partial vacuum acts on the mixture through the conveying means.

9. The method according to claim 1, wherein the setting water for wetting is applied to a first surface of the mixture and the partial vacuum is subsequently applied on a second surface of the mixture opposite the first surface for post-compaction.

10. The method according to claim 1, wherein for wetting with the setting water, a water/solid value w/s of 0.4 to 0.6 is produced in the mixture.

11. The method according to claim 1, wherein the mixture has a partial vacuum applied to it for post-compaction, wherein a partial vacuum of 10 to 25 mbar is generated, wherein the amount of air drawn off to generate the partial vacuum is increased section by section in the advancing direction.

12. The method according to claim 1, wherein a pressure of 100 to 350 bar is applied for pressing the mixture.

13. The method according to claim 1, wherein gypsum fiberboard panels having a thickness of 6 to 50 mm are produced.

* * * * *